United States Patent [19]

Turner

[11] Patent Number: 4,702,092

[45] Date of Patent: Oct. 27, 1987

[54] APPARATUS FOR WET PROCESSING A CONTINUOUS TRAVELING WEB OF MATERIAL

[75] Inventor: James K. Turner, Lincolnton, N.C.

[73] Assignee: Gaston County Dyeing Machine Company, Stanley, N.C.

[21] Appl. No.: 683,720

[22] Filed: Dec. 19, 1984

[51] Int. Cl.[4] ..... D06F 5/02

[52] U.S. Cl. ..... 68/53; 68/175

[58] Field of Search ..... 68/53, 51, 18 F, 17 S, 68/43; 134/111, 196; 28/167

[56] References Cited

U.S. PATENT DOCUMENTS

| | | | |
|---|---|---|---|
| 2,621,505 | 12/1952 | Smith | 68/18 F |
| 2,741,111 | 4/1956 | Smith | 68/175 |
| 2,904,981 | 9/1959 | Macomson | 68/175 X |
| 3,045,315 | 7/1962 | Dusenbury | 68/175 |
| 3,176,483 | 4/1965 | Marsello | 68/43 |
| 3,717,160 | 2/1973 | Tobias | 68/175 X |
| 3,848,439 | 11/1974 | Lopata | 68/175 X |
| 4,235,600 | 11/1980 | Capella et al. | 68/18 R X |
| 4,520,520 | 6/1985 | Johnston et al. | 68/18 F X |

FOREIGN PATENT DOCUMENTS

| | | | |
|---|---|---|---|
| 1460233 | 12/1968 | Fed. Rep. of Germany | 68/175 |
| 146832 | 3/1981 | Fed. Rep. of Germany | 68/175 |
| 1230246 | 3/1960 | France | 68/175 |
| 831245 | 3/1986 | United Kingdom . | |

*Primary Examiner*—Harvey C. Hornsby
*Assistant Examiner*—Frankie L. Stinson
*Attorney, Agent, or Firm*—Shefte, Pinckney & Sawyer

[57] ABSTRACT

Apparatus for wet processing traveling continuous-length textile material includes a narrow U-shaped container for processing liquid through which the material passes in a U-shaped path and an agitating assembly positioned in the container between the reaches of the material path for reciprocating movement parallel to the material. The agitating assembly includes a plurality of unequally spaced displacement members which extend across the width of the material and a substantial extent of the container transversely between the material reaches to define relatively narrow localized spacings between the displacement members and the container walls. Each reciprocal movement of the agitating assembly displaces a relatively large volume of the contained liquid forcing it to pass through the localized spacings at a relatively higher velocity than the actual movement of the agitating assembly, enhancing the liquid application to the material. The unequal spacing of the displacement members prevents repetitive patterned liquid application to the material. A system of circulating the processing liquid through the apparatus and continuously adding fresh liquid maintains the liquid in a clean state and removes lint and debris from the apparatus to prevent their accumulation therein.

40 Claims, 10 Drawing Figures

APPARATUS FOR WET PROCESSING A CONTINUOUS TRAVELING WEB OF MATERIAL

BACKGROUND OF THE INVENTION

The present invention relates to the wet treatment of continuous length web material and more particularly to such apparatus for treating textile material such as carpet and other sheet-like material continuously while traveling in open widthwise extended condition.

In the processing of substantially all types of textile sheet material, it is typical to wash or scour the textile material by wet treatment, usually with ordinary water, either or both before and after printing, dyeing and other chemical treatment of the material in order to remove excess chemicals, foreign matter and the like. For example, in the finishing of tufted and like textile carpet materials, it is conventional to wash the carpet in advance of printing or other dyeing processes, often with the additional application of heat, to clean as well as align and bulk or full the carpet tufts to orient them to best facilitate the uniform application and acceptance of the dye.

As is well known, in any such wet treatment processes, the desired washing and, if applicable, material manipulation is best achieved and enhanced by the maximum application of the treating water or other liquid to the material. For this purpose, a large number of wet treatment apparatus of various constructions have been proposed, examples of which are disclosed in each of the following patents:

U.S. Pat. No. 3,183,690
U.S. Pat. No. 3,406,542
U.S. Pat. No. 3,436,935
U.S. Pat. No. 3,580,015
U.S. Pat. No. 3,640,101
U.S. Pat. No. 3,717,160
U.S. Pat. No. 3,950,968
U.S. Pat. No. 4,018,068
British Pat. No. 831,245
French Pat. No. 1,093,249
French Pat. No. 1,230,246
French Pat. No. 1,410, 143
French Pat. No. 2,039,747

As many of the above-identified patents indicate, textile wet processing apparatus of this general type often provide a liquid bath for treating the textile material in combination with some means for agitating the bath liquid in order to enhance the application of the liquid to the material. It is considered that these apparatus usually suffer one or more disadvantages. First, the degree of agitation produced in the liquid bath often does not provide a sufficiently forceful application of the liquid to the material being treated to obtain markedly improved results. Additionally, the agitating arrangement utilized in many of these apparatus produce a repetitive or cyclical liquid application to the material which causes some portions of the material to receive a substantailly more forceful application of the treating liquid while other portions of the material receive substantially less forceful liquid application. In apparatus employed particularly for the wet treatment of carpet and other tufted or pile-type materials, substantial problems are experienced with the accumulation of fibrous lint and other debris in the bath and on the exposed surfaces of the apparatus, which requires the periodic shutting down of the apparatus for manual cleaning. Indeed, such problems are of such significant proportions that some carpet treating apparatus have been designed and constructed of sufficient size to permit cleaning personnel to physically enter the apparatus when shut down in order to more rapidly and easily remove accumulated lint. As is readily apparent, such apparatus disadvantageously occupies a substantial amount of space and requires the use of large quantities of treating liquid thereby significantly increasing the cost of the apparatus itself as well as the ongoing costs of operation thereof.

In contrast, the present invention provides apparatus for the wet treatment of carpet and other sheet-like textile materials having a novel agitator arrangement effective to produce substantially forceful uniform application of liquid to the material being treated in order to significantly enhance the treatment process, with a liquid circulation system which effectively removes lint and prevents its accumulation in the apparatus.

SUMMARY OF THE INVENTION

Briefly described, the present wet processing apparatus has a container or tank for containing processing liquid, an arrangement for directing a traveling continuous web of material through the container and the processing liquid therein, an agitating assembly disposed in the liquid in the container adjacent the path of travel of the web material therethrough, and an arrangement for moving the agitating assembly generally parallel to the material path and relative to the material and the liquid. The apparatus is preferably utilized in the treatment of textile sheet material, particularly tufted carpet material, with the tufted surface being arranged in facing relation to the agitating assembly during travel through the container.

In the preferred embodiment, the liquid container has two spaced parallel walls and the material directing arrangement causes the textile material to pass through the container and the processing liquid in a U-shaped path having two spaced parallel reaches respectively adjacent and parallel to the container walls. The agitating assembly is positioned in the container in the space between the reaches and the associated arrangement for moving the agitating assembly is adapted to reciprocate it generally parallel to the material reaches. The container walls may be corrugated to further enhance agitation of the liquid upon movement of the agitating assembly.

The agitating assembly preferably includes a plurality of enlarged elongate liquid displacement members with a frame affixing the members in generally parallel spaced relation extending transversely across the width of the textile material with open areas intermediate the displacement members. The displacement members project from a common central plane of their reciprocal movement outwardly toward each reach of the material to define relatively narrow localized spacings between the displacement members and the container walls, which spacings are substantially narrower than the spacing between the common plane and the walls at the open areas between the displacement members. Each displacement member occupies a sufficiently large extent of the container transversely of the material reaches in relation to the spacing between the common plane and the container walls at the open areas so that relatively low velocity reciprocal movement of the agitating assembly causes the displacement members to displace adjacent liquid in the open areas through the narrow localized spacings at substantially higher velocity to force the liquid to be vigorously applied to the material. In the preferred embodiment, the displacement members are cylindrical to project at an inclination to the path of travel of the material for directing the liquid toward the material upon reciprocation, each cylinder having a sufficient radius that the spacing between the common plane and each container wall is at least three times greater than the localized spacings. At least three of the displacement members are provided at unequal spacings from one another to avoid repetitive patterned application of the liquid to the material upon reciprocation of the agitating assembly.

It is also preferred that the material directing arrangement direct the textile material in a generally vertical path through the container. The arrangement for reciprocating the agitating assembly is arranged to impart thereto at least a component of vertical movement and the agitating assembly is of a weight to have a neutral buoyancy in the liquid to require generally equal forces for moving the agitating assembly in each reciprocal direction. Preferably, the neutral buoyancy is achieved by providing one or more of the displacement members with a hollow area in which a sufficient quantity of liquid is contained to produce the neutral buoyancy.

The wet processing apparatus is also provided with a system for circulating the processing liquid through the container and for removing line therefrom. This liquid circulating system includes a pump for delivering liquid into the container at the bottom thereof and an arrangement for receiving overflow of the liquid from the top of the container for maintaining the liquid at a predetermined level therein. This overflow receiving arrangement includes a trough for containing the overflow liquid. A conduit arrangement between the trough and the pump is provided for delivering the overflow liquid thereto. A filter is provided in the form of a screen located in the trough about the conduit for the purpose of separating lint from the overflow liquid entering the conduit. Another arrangement is provided for continuously wiping accumulated lint from the screen. The material directing arrangement further directs the textile material through the trough after passing through the container. Preferably, the overflow receiving arrangement includes an overflow arrangement for removing a portion of the liquid from the liquid circulating system, the liquid circulating system further including an arrangement for adding fresh liquid to the pump to replace the removed liquid. An arrangement for heating the liquid is provided for producing bulking of the tufts of the carpet material upon reciprocation of the agitating assembly.

In an alternate embodiment of the wet processing apparatus, a second container, a second material directing arrangement, a second agitating assembly and a second reciprocating arrangement of the type of the first above-described ones thereof are provided. The first and second material directing arrangements are associated for directing the material from the first container into the second container. A liquid circulating system is provided for circulating the processing liquid through the first and second containers to produce a flow of liquid therethrough generally counterdirectional to the movement of the material therethrough. The liquid circulating system preferably includes an arrangement for delivering liquid to the second container at the top thereof, an arrangement providing liquid communication between the first and second containers for flow of liquid from the second container into the first container, and an arrangement at the top of the first container for overflow of the liquid therefrom. Preferably, a spray arrangement is employed to direct liquid onto the material upon leaving the top of the second container so that the spray liquid drains from the material into the second container. It is further preferred in this embodiment that the walls of both containers are corrugated to further enhance liquid agitation.

DESCRIPTION OF THE PREFERRED EMBODIMENT

Figure 1:
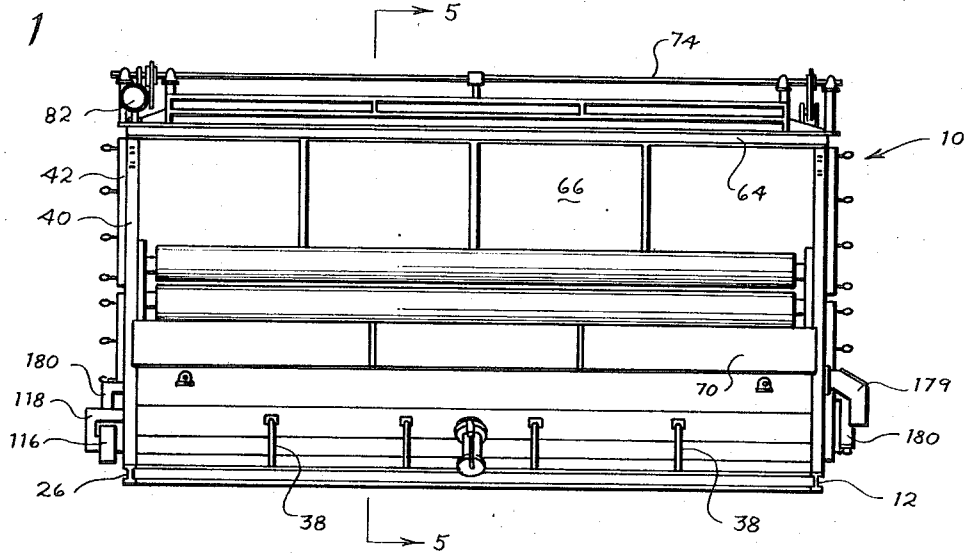
FIG. 1 is a front elevation of an apparatus for wet processing a continuous traveling web of material according to the preferred embodiment of the present invention.
Figure 3:
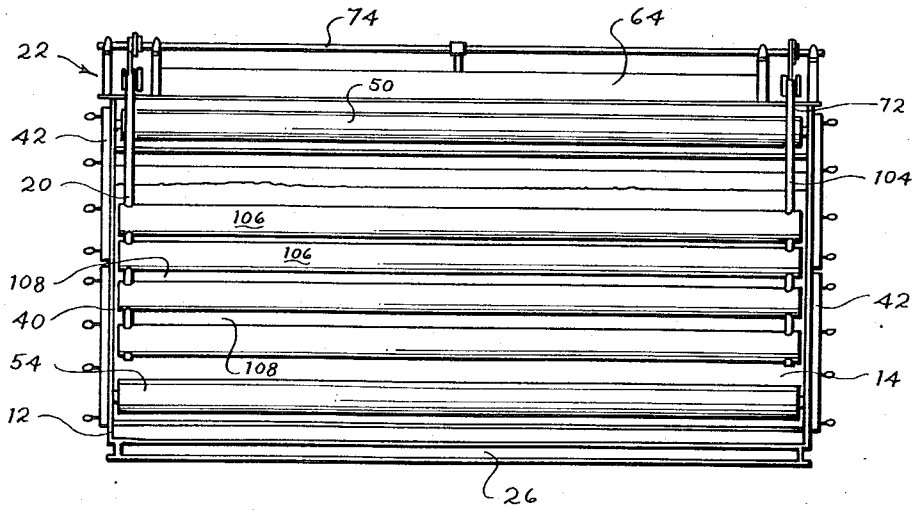
FIG. 3 is a vertical section thereof taken along line 3—3 of FIG. 2.
Figure 2:
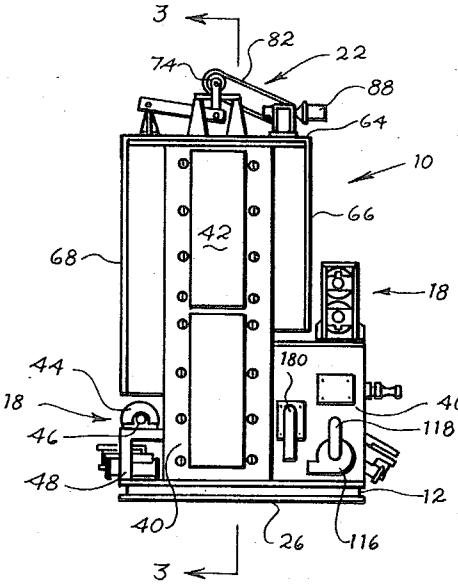
FIG. 2 is a left end elevation thereof.
Figure 9:
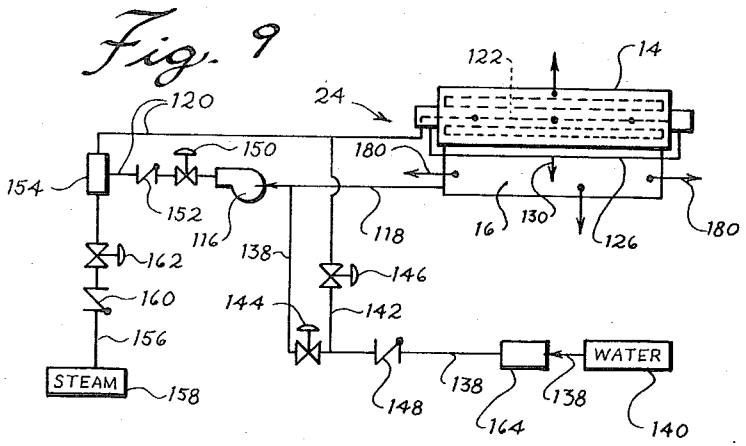
FIG. 9 is a schematic diagram of the liquid circulating system of the apparatus.

Referring now to the accompanying drawings, and initially to FIGS. 1–4, there is shown generally at 10 an apparatus according to the present invention as preferably embodied for washing tufted and other textile carpet and similar materials. FIGS. 1 and 2 indicate the exterior and general proportions of the apparatus 10 as arranged for handling the typically considerable web width of textile carpets which must be accommodated. In general, the apparatus 10 includes a frame 12 supporting a main container or tank 14 and a trough section 16 for containing processing liquid, preferably water; an arrangement of idler and driven rolls, generally indicated at 18, for directing the carpet material C in widthwise extended condition through the apparatus 10, particularly through the main container 14 and the trough 16; an agitating assembly 20 disposed in the container 14 in the processing liquid therein, and a motor-operated driving arrangement 22 operatively connected with the agitating assembly 20 for reciprocating it in the processing liquid. A circulating system, indicated schematically at 24 in FIG. 9, is provided for continuously circulating the processing liquid through the container 14 and the trough 16 and for removing lint and debris released from the carpet material C into the liquid during processing.

The frame 12 includes a rectangular floor-supported base 26 of I-beam construction. An upright cradle assembly 28 is mounted centrally on the end beams of the base 26 and extends the full width of the frame 12 therebetween. The container 14 includes a main body 30 supported within the cradle assembly 28 in substantially vertical orientation and extending the full width of the frame 12. The main body 30 of the container 14 is constructed of appropriate sheet metal material, preferably stainless steel, fabricated in a U-shaped configuration providing a pair of closely-spaced parallel walls 32 and a connecting bottom wall 34 extending transversely therebetween, each of which extend the full width of the frame 12 with the parallel walls 32 extending substantially the full height of the cradle asembly 28 and being unconnected at the tops thereof to provide an open top to the container 14. The trough section 16 similarly includes a main body 36 fabricated in a generally U-shaped, open-topped configuration from stainless steel or another appropriate sheet metal material to the full widthwise dimension of the frame 12. The trough section 16 is mounted at the lower forward side of the frame 12 by affixation of the rearward leg of the main body 36 to the forwardly facing surfaces of the cradle assembly 28 and by support legs 38 extending vertically from the front widthwise beam of the frame 12. The frame 12 further includes an assembly of stainless steel sheet metal plates and panels, indicated collectively at 40 in FIGS. 1 and 2, which are affixed at each end of the frame 12 to the base 26, the cradle assembly 28 and the end edges of the main bodies 30,36 of the container 14 and the trough 16, respectively, to sealingly enclose the ends thereof. Doors 42 are provided in the end panel assemblies 40 opening into the container 14 to provide access thereto for initial thread-up of carpet or other textile material to be processed and also to permit cleaning or repair of the apparatus if necessary.

The arrangement 18 of idler and driven rolls includes an entrance idler roll 44 extending transversely across the width of the frame 12 at the lower rear side thereof and rotatably supported by spaced bearing assemblies 46 mounted at a slight elevated spacing above the base 26 on upright brackets 48 affixed at the opposite ends of the rear beam of the base 26. A pair of idler rolls 50 are similarly supported rotatably transversely across the width of the frame 12 immediately above and respectively adjacent the front and back walls 32 of the container 14 by bearing assemblies 51 mounted on the cradle assembly 28. Another idler roll 52 is rotatably supported across the width of the container 14 in the bottom thereof by bearing assemblies 54 mounted on the bottom wall 34 of the container 14. Another idler roll 56 is similarly supported across the width of the trough section 16 in the bottom thereof by bearing assemblies 58 mounted therein. A pair of nip rolls 60 driven by an appropriate motor (not shown) are rotatably mounted across the width of the frame 12 at the front side thereof in upright support members 62 mounted on top of the forwardmost upper surfaces of the end panel assemblies 40 for the trough section 16. These idler and driven rolls define a path P (FIG. 4) for the carpet C which causes the carpet C to pass in a U-shaped path along spaced parallel reaches P' through the main container 14 and successively therefrom in a similar but considerably shorter U-shaped path through the trough section 16.

Top, front and rear panels 64,66,68, respectively, are mounted on the cradle assembly 28 and to the end panel assemblies 40 to substantially enclose the container 14 and the predominant portion of the material path P from the entrance roll 44 to the trough section 16. Front dress panels 70 mounted to the base 26 and to the forward surfaces of the end panel assemblies 40 enclose the forward side of the trough section 16. Additional doors (not shown) are provided in the top panel 64 to provide access to the container 14.

The driving arrangement 22 for the agitating assembly 20 is mounted on the top panel 64 and supports the agitating assembly 20 to extend in depending fashion through openings 72 in the top panel 64 into the main tank 14 to substantially the depth of the idler roll 52 therein. The driving arrangement 22 includes a drive shaft 74 which extends across the top panel 64 substantially the full width of the frame 12 and is rotatably supported in two pairs of spaced bearings 76 mounted at opposite ends of the top panel 64 on upright standards 78 and brackets 80 affixed to the top panel 64. The drive shaft 74 is driven by an electric motor 82, also mounted on the top panel 64, through a sprocket 84 drivenly associated with the motor 82 and another sprocket 86 fixed on the drive shaft 74 and operatively driven by the sprocket 84 through an endless chain 88 trained about each sprocket 84,86. A circular bearing assembly 90 is fixed eccentrically to the drive shaft 74 at each end thereof between the bearings 76 of each respective pair thereof. Each circular bearing assembly 90 has a connecting plate 92 rotatably supported at one of its ends thereabout by a corresponding circular opening in such end of the connecting plate 92 in which the bearing assembly 90 is rotatably received. Each connecting plate 92 depends from its respective bearing assembly 90 and has its opposite end similarly rotatably affixed to another bearing member 94. Each bearing member 94 is mounted on a stub shaft 96 supported on a clevis 98 at the free end of a rocker arm 100 the opposite end of which is pivotably mounted on an upright support 102 fixed to the top panel 64 at a rearward spacing from the drive shaft 74. Thus, it will be understood that, as the electric motor 82 operates through the sprockets 84,86 and chain 88 to rotate the drive shaft 74, the eccentrically-mounted circular bearing assembly 90 rotates slidably within the receiving opening 93 in the connecting plate 92 to produce a vertically upward and downward reciprocation of the connecting plate 92 and the bearing member 94 affixed thereto under the constraint of the pivoted rocker arm 100.

The agitating assembly 20 includes a pair of linear side frame members 104 arranged in spaced parallel relation vertically within the container 14 at its opposite ends with four elongate cylindrical liquid displacement members 106 extending widthwise through the container 14 between, and being affixed at their ends to, the frame members 104 in spaced, parallel, coplanar relation leaving open areas 108 between the displacement members 106. The upper ends of the side frame members 104 are formed as clevises 110 which are respectively mounted rotatably to the stub shafts 96 of the driving arrangement 22 between the arms of the rocker arm clevises 98, so that the agitating assembly 20 reciprocates vertically with the aforedescribed reciprocation of the driving arrangement 22.

Figure 5:
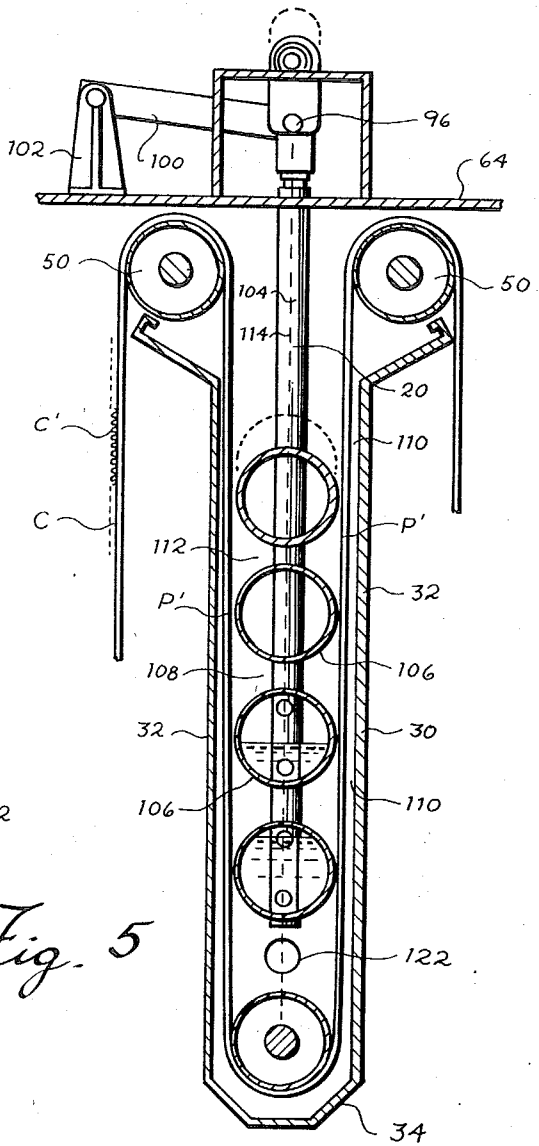
FIG. 5 is a vertical section thereof taken along line 5—5 of FIG. 1.
Figure 4:
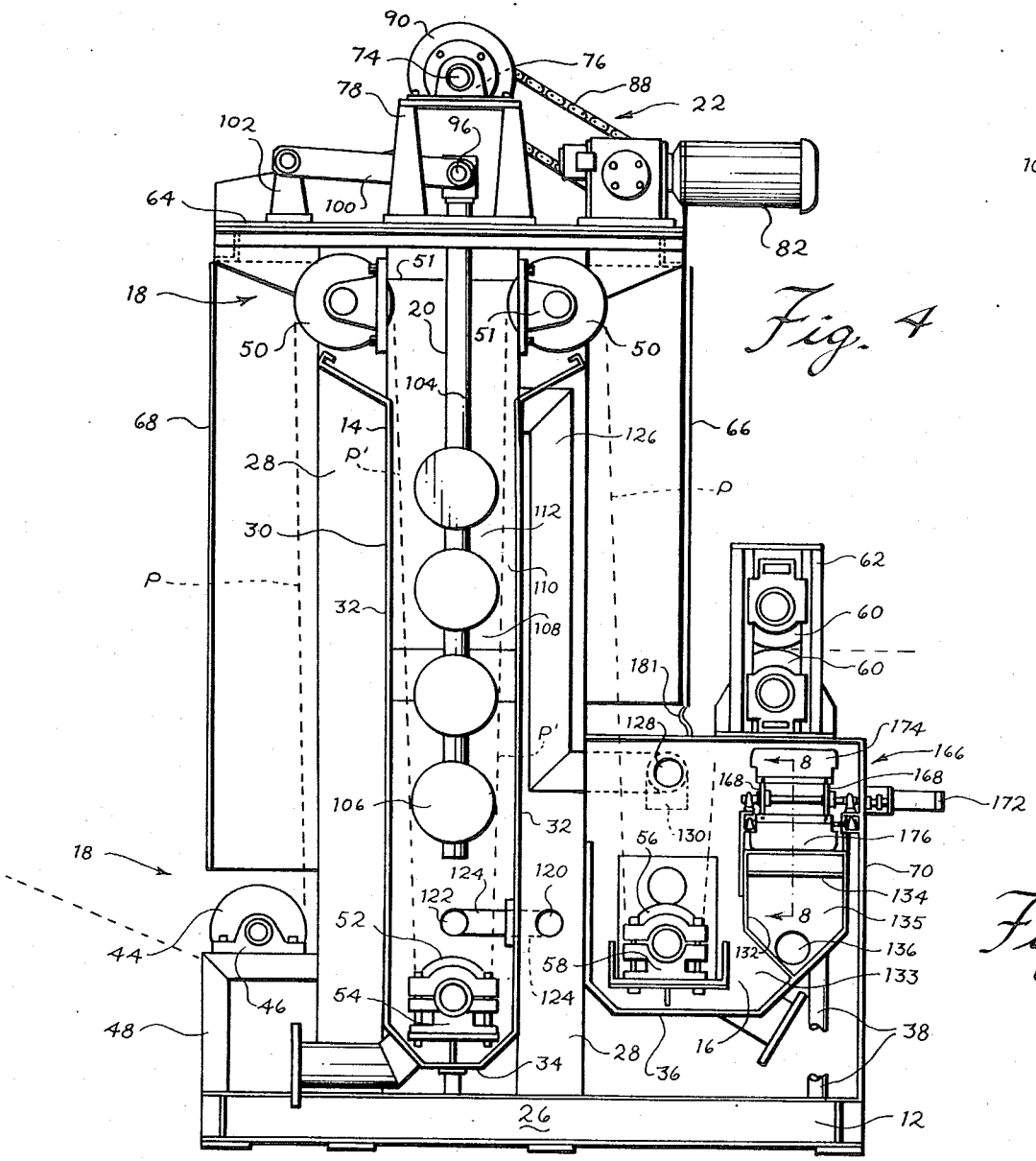
FIG. 4 is another left end elevation thereof similar to FIG. 2 but with the end plate assemblies removed.
Figure 6:
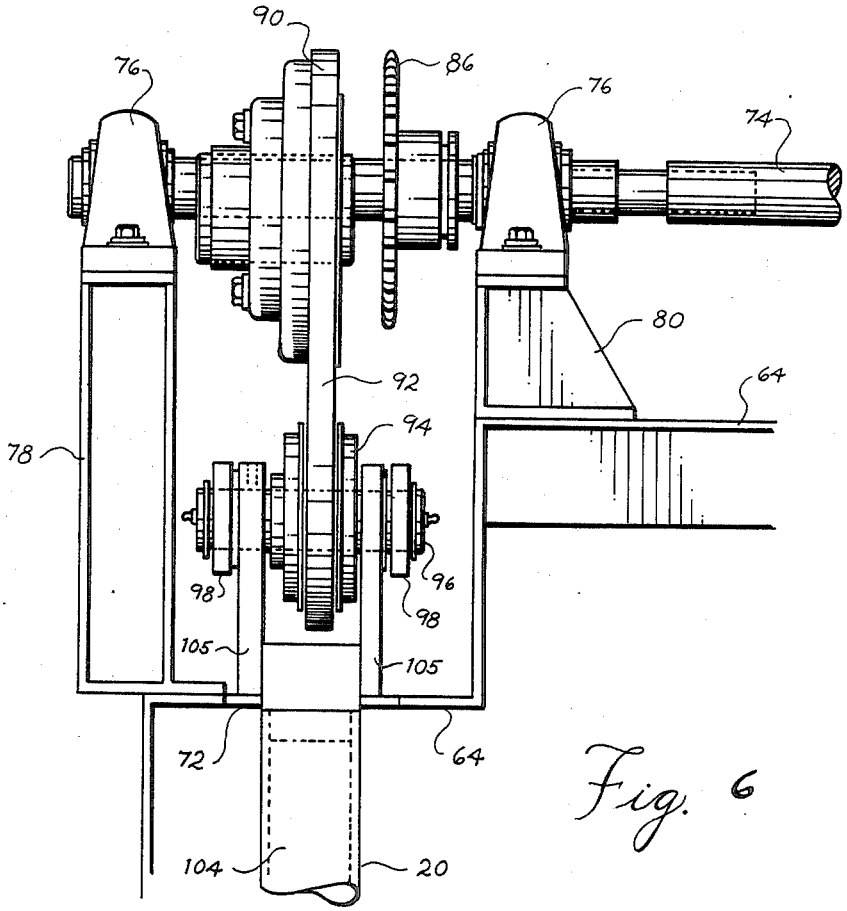
FIG. 6 is an enlarged front elevation of a portion thereof showing the arrangement for reciprocating the agitating assembly.
Figure 7:
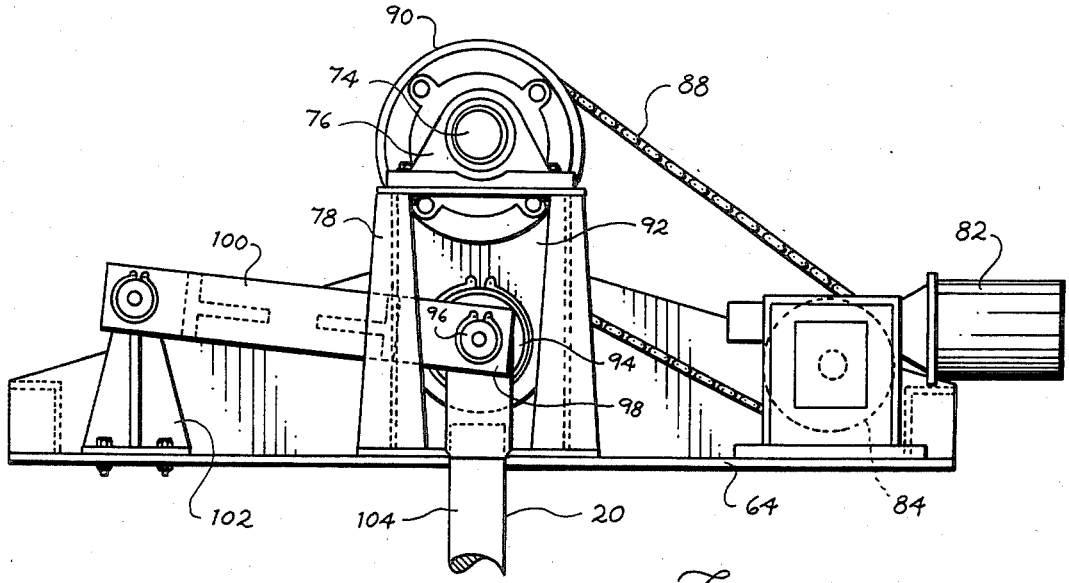
FIG. 7 is an enlarged left end elevation of the reciprocating arrangement of FIG. 6.

For purposes to be hereinafter explained, the cylindrical displacement members 106 are unequally spaced from one another by increasing distances from the uppermost to the lowermost displacement members 106 (FIGS. 4 and 5). The displacement members are of a selected radius to extend to closely adjacent each reach P' of the material path P through the container 14 to define relatively narrow localized spacings 110 between the displacement members 106 and the container walls 32 in relation to the larger spacings 112 between the common plane of the displacement members 106, indicated by the broken line 114 in FIG. 5, and the container walls 32. Preferably, the radius of the cylindrical displacement members 106 is such that the larger spacings 112 are at least three times greater than the localized narrow spacings 110. As seen in FIG. 5, the cylindrical displacement members 106 are tubular and are enclosed at their ends, with one or more of the displacement members 106, preferably the two lowermost ones thereof, being filled with sufficient liquid to provide the agitating assembly 20 with a weight to have a neutral buoyancy in the processing liquid in the container 14 so that generally equal forces are required to be exerted by the driving arrangement 22 to move the agitating assembly 20 in each reciprocal direction.

The container 14 and the trough 16 are to be filled with treating liquid for operation, the circulating system 24 being designed to circulate the liquid continuously between the tank 14 and the trough 16, remove some liquid from the system and replace it with fresh liquid, and continuously remove lint and debris from the recirculating liquid which is released thereinto by the carpet material C. The circulating system 24 is best understood with reference to FIG. 4 and the schematic diagram of FIG. 9. The circulating system 24 includes a liquid pump 116 mounted on the end plate assembly 40 adjacent the trough section 16 at the left side of the apparatus 10. The input side of the pump 116 is connected with a conduit 118 opening through the end panel assembly 40 into the trough 16 to receive liquid therefrom, as hereinafter more fully explained. The output side of the pump 116 is connected with another conduit 120 which extends through the end plate assembly 40 and the cradle assembly 26 at the left end of the apparatus 10 just forwardly of the lower left end of the forwardmost container wall 32 and which has a rearwardly turned conduit leg 124 opening through the forward container wall 32 into the bottom region of the container 14. The conduit leg 124 is connected with a header pipe 122 which extends within the container 14 across the full width thereof immediataly above the idler roll 52 and which has three spaced openings at the ends and central section of the header pipe 122. A pair of overflow pipes 126 open into the upper region of the container 14 through the upper portion of the forward container wall 32 adjacent the outward ends thereof and extend downwardly along the end panel assemblies 40 to immediately above the rearward portion of the trough section 16. The lower ends of the overflow pipes 126 connect with the opposite ends of a header pipe 128 which extends across the width of the trough 16 and ahs a downwardly opening spout 130 midway along its length to deliver overflowing liquid from the container 14 into the trough 16.

The trough 16 includes a solid vertical interior wall 132 extending the full width of the trough 16 and a portion of the height thereof intermediate the location of the header pipe 128 and the forward outer wall of the trough 16. The interior wall 132 serves to divide the trough 16 into a rearward main section 133 defined between the wall 132 and the rearward outer wall of the trough 16 and a forward secondary section 135 between the wall 132 and the forward outer wall of the trough 16. A mesh screen 134 is affixed between the interior wall 132 and the forward outer wall of the trough 16 across the secondary section 135 to filter fibrous lint and other debris and foreign matter from the liquid flowing over the wall 132 from the main trough section 133 into the secondary section 135. A drain tube 136 is positioned in the bottom of the secondary trough section 135 in open communication therewith, opens outwardly through the end panel assembly 40 at the left end of the apparatus 10 and is connected with the conduit 118 for delivering the filtered liquid from the secondary trough section 135 to the intake side of the pump 116 to be recirculated to the container 14.

A conduit 138 extends from a source of fresh liquid 140 into communicatin with the conduit 118 intermediate the trough 16 and the pump 116 and a branch conduit 142 extends from the conduit 138 into communication with the conduit 120 intermediate the pump 116 and the header pipe 122. A valve 144 is provided in the conduit 138 intermediate the branch conduit 142 and the conduit 118, and similarly a valve 146 is provided in the branch conduit 142. Another valve 150 is provided in the conduit 120 immediately following the pump 116. A conventional device 154 for mixing steam and liquid is provided in the conduit 120 following the valve 150 and communicates through a conduit 156 with a source of steam 158. Another valve 162 is provided in the conduit 156 so that, as desired, steam can be added to the liquid in the circulating system 24 to elevate the liquid temperature to a selected level. A conventional flapper-type check valve 148 is provided in the conduit 138 between the fresh liquid source 140 and the branch conduit 142 for preventing reverse liquid and steam flow in the conduit 138 toward the fresh liquid source 140. Another flapper-type check valve 152 is provided in the conduit 120 between the valve 150 and the steam-and-liquid mixing device 154 to prevent reverse liquid and steam flow in the conduit 120 toward the pump 116. Similarly, a third flapper-type check valve 160 is provided in the conduit 156 between the steam source 158 and the valve 162 to prevent reverse liquid and steam flow toward the steam source 158. When starting-up the apparatus 10, each valve 144,146,150,162 is initially closed. The main container 14 and the trough 16 are initially filled with fresh liquid for start-up of the apparatus 10 by opening the valve 146 while leaving the other valves 144,150,162 closed, to deliver the fresh liquid directly into the conduit 120 and therefrom into the container 14 until both the container 14 has been filled and the trough 16 has been filled from the liquid overflow from the container 14, after which the valve 146 is closed. During operation of the apparatus 10 as more fully explained hereafter, the valve 150 is opened for liquid circulation by the pump 116 through the conduits 118,120. The valve 144 may be opened to permit fresh liquid to be placed into the system at the pump 116 through the conduit 138, and a flow meter, representatively indicated at 164, is provided in the conduit 138 at the liquid source 140 to permit control of the rate at which fresh liquid is added. As desired, the valve 162 is opened during operation to add steam to the system to heat the liquid to a desired temperature.

Figure 8:
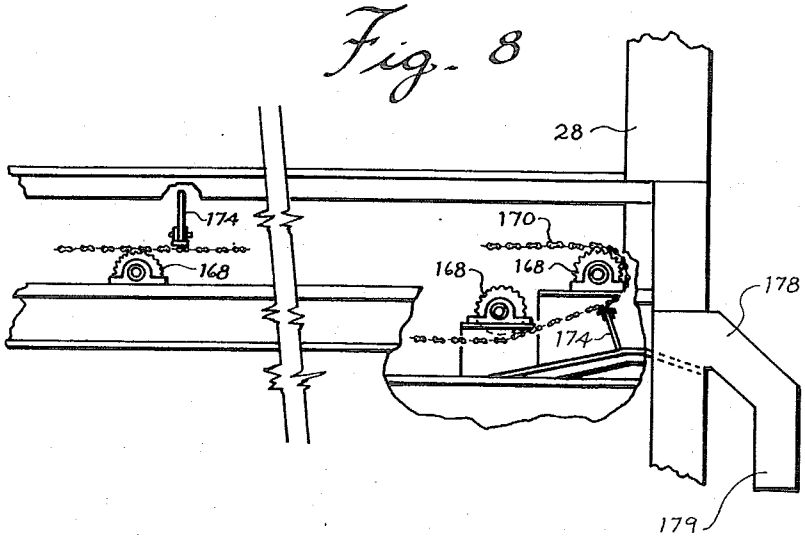
FIG. 8 is a vertical section taken along line 8—8 of FIG. 4 showing the trough section of the apparatus.

A wiper mechanism, generally indicated at 166, is mounted on the interior and forward trough walls to progressively remove from the screen 134 thereacross all lint and other debris filtered from the circulating liquid. The wiper mechanism 166 includes two sets of sprockets 168 rotatably mounted side-by-side respectively along the interior and forward trough walls thereabove with a corresponding pair of endless drive chains 170 trained about the sprockets 168. One pair of side-by-side sprockets 168 are connected to the drive shaft of a small electric motor 172 for driving the chains 170. Several wiper blades 174 are mounted to the outward edges of the chains 170 transversely therebetween and at spacings therealong to move along the lower run of the chains 170 in close wiping relation with the screen 134 to remove lint and debris therefrom. The motor 172 is operated to cause the lower run of the chains 170 and the wiper blades 174 to move from left to right as viewed in FIG. 8 and the sprockets 168 adjacent the right end of the trough 16 define a slightly upward incline at the end of such lower run. A solid plate 176 is mounted to the right end panel assembly 40 and to the interior and forward trough walls to extend from the screen 134 at the corresponding upward incline and then at a downward incline to the right end panel assembly 40 whereat is provided a lint removal opening 178 and a lint removal tube 179 in the right end panel assebly 40 through which the removed lint is expelled by each wiper blade 174 as it completes the lower run.

A pair of tubular overflow pipes 180 open through the end panel assemblies 40 to each end of the main section of the trough 16 at a level slightly above the solid interior rough wall 132, from which location the overflow pipes 180 extend outwardly and downwardly from the end panel assemblies 40 and connect to suitable drain pipes (not shown) in order to maintain the overall liquid level in the trough 16 at a predetermined level slightly above the level of the upper edge of the interior trough wall 132. In this manner, the wiper blades 174 of the wiper mechanism 166 do not expel significant amounts of the processing liquid with the lint accumulations passed through the lint removal opening 178. Additionally, the overflow pipes 180 serve to progressively skim small quantities of the processing liquid from the trough 16 to be removed from the circulating system 24, permitting corresponding quantities of fresh replacement liquid from the fresh liquid source 140 to be added through the conduit 138 to the circulating system 24.

In typical preferred use of the apparatus 10 for a carpet washing operation, a web of carpet material C opened to its full widthwise extent is threaded through the apparatus 10 in sequence about the idler rolls 44,50,52,50,56 and between the nip rolls 60 as illustrated in FIG. 4 with the tufted or pile side of C′ of the carpet C facing upwardly as it is trained beneath the entrance roll 44 so that the projecting tufts or pile face and extend toward the agitating assembly 20 as the carpet C passes through the main container 14. The doors 42 in the end panel assemblies 40 and the doors in the top panel 64 are opened to permit access to the interior of the container 14 to assist in and facilitate the thread-up process. Once threadingup of the carpet C is completed, the doors 42 are closed and sealed shut, following which the valve 146 is opened to deliver fresh liquid from the source 140 through the conduits 138,142,120 and therefrom through the header pipe 122 into the container 14. Once the container 14 has filled and sufficient overflow therefrom has spilled through the overflow pipes 126 into the trough 16 to fill its main and secondary sections 133,135 to the level of the overflow pipes 180, the valve 146 is closed. Usually, the treating liquid used in the apparatus 10 is ordinary water. Next, the valve 150 is opened and the pump 116 is actuated to begin circulation of the treating liquid through the circulating system, and the valve 162 is opened to admit steam to the mixing device 154 to be mixed with the circulating liquid to increase the temperature of the liquid to the desired value. The valve 144 is then opened partially to a setting which has been predetermined to establish a rate of flow of fresh liquid from the liquid source 140 to supply sufficient fresh liquid to the circulating system 24 to replace liquid taken up by the carpet material C as it becomes wetted in passing through the apparatus 10 and to provide sufficient excess liquid to maintain a liquid overflow from the container 14 to the trough 16. Next, the motors to the nip rolls 60 and the driving arrangement 22 for the agitating assembly 20 are energized to begin movement of the carpet C through the apparatus with simultaneous reciprocation of the agitating assembly 20, as circulation of the treating liquid through the circulating system 24 as above-described continues.

Within the container 14, each reciprocal movement of the agitating assembly 20 displaces a volume of the treating liquid in the container 14 from the open areas adjacent the displacement members 106 in the direction of movement and vacates an equal volume of space behind the displacement members 106. As will be understood, the displaced liquid will naturally move in the container 14 to occupy the vacated spaces and to do so must pass through the localized narrow spacings 110 between the displacement members 106 and the container walls 32. Such movement of the displaced liquid produces considerable agitation thereof and causes the moving displaced liquid to be applied repetitively to the carpet material C. The relatively large radius of the cylindrical displacement members 106 is selected to occupy substantially the extent of the container 14 transversely between the two parallel reaches P′ of the path P of the carpet C and to leave only the relatively narrow spacings between the displacement members 106 and the container walls 32 to maximize the volume of liquid displaced upon each reciprocal movement of the agitating assembly 20 and to leave only a restricted spacing for the large volume of displaced liquid to pass in moving to occupy the spaces vacated by the displacement members 106. This relationship causes the displaced liquid to move at a substantially increased velocity over the actual velocity of movement of the agitating assembly 20 so that the turbulence and agitation produced is correspondingly maximized to a sufficient degree to cause the carpet material C to be repetitively flexed toward and away from the agitating assembly 20, while at the same time causing the individual tufts of the carpet material to be moved back and forth. Furthermore, the aforedescribed unequal spacing of the displacement members 106 prevents the patterned application of the liquid to the carpet material, i.e. a high velocity liquid application to periodic widthwise areas of the traveling carpet material with substantially lesser velocity liquid application between such areas, which will be understood to produce an undesirable discontinuous appearance to the carpet material C. In this manner, the liquid application to the carpet C is significantly enhanced in terms of the degree or amount and the quality of the liquid application and results in the individual tufts of the carpet C being effectively disentangled and raised to extend outwardly in substantially uniform alignment from the carpet C. The carpet C is therefore better prepared for and better facilitates uniformity in subsequent treatments such as dyeing, printing or other chemical treatment.

In addition to the advantageous treating effect on the carpet material C, the ability of the agitating assembly 20 to produce high velocity liquid movement upon relatively low velocity movement of the agitating assembly 20 offers structural advantages as well in that boiling point. As will be understood, the fresh liquid from the source 140 thereof is at a substantially cooler temperature than the boiling point and, therefore, the addition of such fresh liquid through the conduit 138 to the inlet side of the pump 116 serves to sufficiently cool the heated liquid in the system at the location at which it enters and passes through the pump 116 so that the pump 116 is enabled to operate in a normal manner uninhibited by the maintenance of the liquid elsewhere in the system at its boiling point. This capability of the apparatus 10 for boiling operation, in conjunction with the aforementioned agitation produced by the reciprocating agitating assembly 20, permits the apparatus to perform a fulling and bulking of the carpet tufts by exposing them to an elevated temperture while manipulating them to insure complete exposure to the heated liquid. More particularly, the aforementioned repetitive flexing of the carpet material C and the back and forth manipulation of its individual tufts serves to relieve the natural friction between the individual fibers of the carpet yarn sufficiently to permit shrinkage of the fibers under the effect of the heated liquid. Accordingly, the fulling and bulking of the carpet tufts further enhances the alignment thereof to extend uniformly outwardly of the carpet material C and produces the appearance of a greater fabric weight and yarn quantity per square yard of the carpet. The resultant bulking and uniform outwardly-extending alignment of the carpet tufts is particularly advantageous in preparing the tufts to be uniformly penetrated by dye at a subsequent dye range thereby to enhance the uniformity of dye application to the individual tufts at the dye range. Moreover, the operation of the apparatus at elevated temperatures provides the complimentary advantage of effectively preheating the carpet to further enhance the uniformity of dye take-up by the carpet at the dye range.

The relatively small size of the apparatus permitted by the lint collecting and liquid cleaning capability of the circulating system 24 additionally helps to minimize radiant heat loss from the apparatus 10 when operating under heated conditions to the extent that no exhaust fan is required in use of the present apparatus 10 to remove radiant heat from the surrounding environment as is necessary with conventional wet treatment apparatus when operated under heated conditions. The top, front and rear panels 64,66,68 enclosing the container 14 contain any steam released from the system. Such released steam condenses on the interior surfaces of the front and top panels 64,66 so that the condensed liquid will flow back into the container 14 or the trough 16. A rubber water seal 181 extends between the front panel 66 and the top surfaces of the end panel assemblies 40 for the trough section 16 to prevent the escape of steam released from the system and to direct condensed liquid into the trough 16. The rear panel 68 contains released steam environment through which the carpet material C passes in its path P upon entering the apparatus 10. The steam contained in this area of the apparatus 10 condenses on the relatively cool carpet material C along this portion of the path P thereby preheating the carpet material C before entering the container 14 and also aiding in preventing the escape of steam from the apparatus 10.

Figure 10:
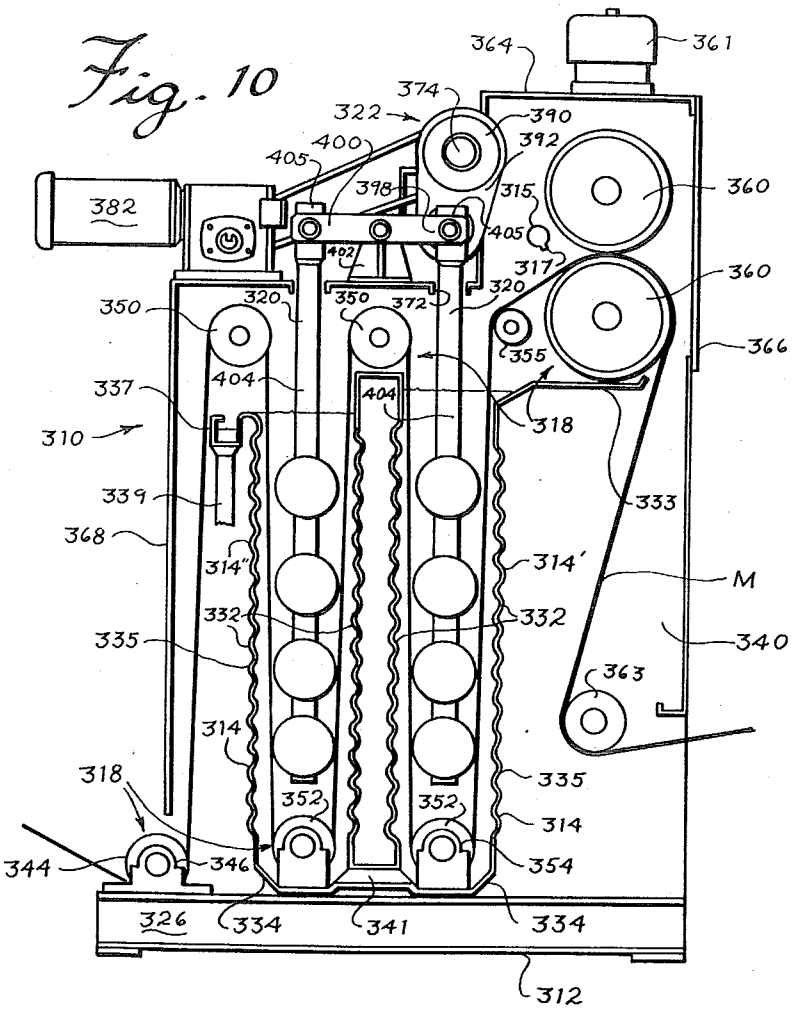
FIG. 10 is a left end elevation with end plate assemblies removed similar to FIG. 4 showing another apparatus for wet processing a continuous traveling web of material according to an alternate embodiment of the present invention.

With reference now to FIG. 10, an alternate embodiment of the present invention is shown as preferably embodied in an apparatus, generally indicated at 310, for washing various types of textile sheet materials, as well as carpet material. The apparatus 310 differs primarily from the apparatus 10 of FIGS. 1–9, first, in its provision an assembly of two successive main treatment containers 314 through which the material M being treated passes successively and, second, in its circulating system. In general, the apparatus 310 includes a frame 312 supporting the dual tank assembly 314, an arrangement of idler and nip rolls 318 for directing the material M through the apparatus and particularly through successive U-shaped paths through the dual container assembly 314, agitating assemblies 320 in each container section of the container assembly 314, and a driving arrangement 322 for reciprocating each agitating assembly 320.

The frame 312 includes a rectangular I-beam base 326 centrally on which the dual container assembly 314 is mounted in upright disposition across the full width of the base 326. The container assembly 314 includes two relatively narrow U-shaped containers 314',314" each of which is constructed of appropriate sheet metal material fabricated to provide parallel spaced vertical walls 332 joined by a transverse bottom wall 334 with the container top left open and with the two containers 314',314" being arranged in side-by-side relation with adjacent walls 332 oriented in parallel relation to one another and joined together at their respective top edges. The container walls 332 are preferably provided with widthwise corrugations 335 for a substantial portion of their height to enchance the liquid agitation produced by the agitating assemblies 320. As desired, flat panels may be affixed to the outward surfaces of the corrugated container walls 332 to enclose widthwise-extending channels through which steam may be circulated for heating the containers 314',314". The forwardmost outwardly facing wall 332 of the forwardmost container 314' extends forwardly at a slight upward incline to adjacent the front side of the apparatus 310. The rearwardmost outward wall 332 of the rearwardmost container 314" terminates at a slightly lower height than the walls of the forwardmost container 314' with the uppermost edge of such rearward wall 332 having affixed thereto a widthwise extending channel portion 337 which connects to a drain pipe 339 extending to a suitable drain or reservoir (not shown). Several cross-over pipes 341 extend between and open through the interior facing walls 332 of the tanks 314',314" at the bottoms thereof to provide liquid communication therebetween. Upright end panel assemblies 340 are affixed to the base 326 and sealingly to the end edges of the dual container assembly 314 to enclose the containers 314',314". Top, front and rear panels 364,366,368 are mounted to and extend between the end panel assemblies 340 to substantially enclose the apparatus 310.

An entrance idler roll 344 extends across the full width of the base 326 at the rear side therof and is rotatably mounted in bearings 346 mounted at opposite rearward sides of the base 326. A pair of idler rolls 350 extend across the full width of the apparatus 310 respectively above and immediately rearwardly of each container 314',314" and are rotatably supported in bearings (not shown) in the end panel assemblies 340. Another pair of idler rolls 352 extend respectively across the width of each container 314',314" in the bottoms thereof and are rotatably supported in bearings 354 mounted in the bottoms of the containers 314',314". A small diameter bow roll 355 extends across the width of the apparatus 10 above and slightly forwardly of the forwardmost container 314' and is rotatably supported by bearings (not shown) on the end panel assemblies 340. The bow roll 355 rotates as an idler roll as the material M moves through the apparatus 310 and effectively flexes the material M widthwise to eliminate wrinkles therefrom. A pair of driven nip rolls 360 atop the other extend across the width of the apparatus 310 immediately above the forwardly extending portion 333 of the forwardmost wall 332 of the container 314' and are rotatably supported at their ends by the end panel assemblies 340 and drivenly connected with a drive motor 361 mounted on the top panel 64. An exit idler roll 363 extends across the width of the apparatus 310 at a slight elevation above the base 326 at the forward side thereof and is rotatably supported by bearings on the end panel assemblies 340. As will thus be understood, the arrangement 318 of idler and driven rolls defines a path P for the material M through the apparatus 310, particularly including successive U-shaped paths having parallel reaches P' through the containers 314',314".

The agitating assembly 320 disposed in each container 314 is identical in construction to that described above, including side frame members 404 which respectively extend upwardly through openngs in the top panel 364 and have clevises 405 at their upwardly extending ends. The driving arrangement 322 for the agitating assemblies 320 is mounted on the top panel 364 at each end thereof and is also of substantially the same construction as described above, except that the rocker arms 400 at each end of the driving arrangement 322 are pivotably mounted to their upright supports 402 at central locations intermediate the ends of the rocker arms 400 with clevises 398 formed at both the forward and rearward ends of the rocker arms 400. The clevis ends 398 of the rocker arms 400 are respectively mounted pivotably to the clevises 405 of the frame members 404 of the agitating assemblies 320 in the forward and rearward containers 314',314". Connecting plates 392 are rotatably affixed to the forward clevises 398 of the rocker arms 400. As in the above-described embodiment of FIGS. 1–9, the connecting plates 392 extend upwardly from the rocker arms 100 and are rotatably supported about circular bearing assemblies 390 eccentrically mounted at the oppposite ends of a drive shaft 374 chain driven by an electric motor 382. In this manner, operation of the motor 382 to rotate the drive shaft 374 and the circular bearing assemblies 390 produces reciprocal movement vertically of the connecting plates 392 which in turn operate to reciprocably pivot the rocker arms 400 to cause synchronous opposed vertical reciprocating movements of the agitating assemblies 320 in their respective containers 314',314".

The liquid circulating system of the apparatus 310 is effective to provide liquid flow reversely from the forwardmost container 314' to the rearwardmost container 314" essentially counterdirectionally to the material path P. As with the apparatus 10 of the embodiment of FIGS. 1–9, each container 314 is to be filled in operation with an appropriate treating liquid, preferably water. A liquid spray tube 315 is mounted between the end panel assemblies 340 immediately rearwardly of the nip location of the nip rolls 360 and has a plurality of spray nozzles 317 fitted therein and directed downwardly toward the material path P. The spray tube 315 is connected with a source of fresh liquid (not shown) to provide a final cleansing spray saturation to the material M immediately prior to its squeezing passage between the nip rolls 360. Since the material M is already substantially saturated with the treating liquid from having passed through the liquid in the two containers 314', 314", a significant portion of the spray liquid from the spray tube 315 will flow reversely along the material M and therefrom into the forwardmost container 314' to continuously add fresh liquid thereto, while a substantial portion of the saturating liquid held by the material M is removed therefrom by the squeezing action of the nip rolls 360 and falls onto the forwardly extending wall portion 333 of the forwardmost container 314' for return flow thereinto. The liquid in the forward container 314' passes freely into the rearward container 314" through the cross-over pipes 341. The level of liquid in the rearward container 314" therefore rises with the addition of fresh liquid to the forward container 314' from the spray tube 315, with a portion of the liquid at the top level in the rearward container 314" progressively overflowing therefrom into the channel portion 337 and the drain pipe 339. Thus, as will be understood, the circulating system of the apparatus 310 causes the processing liquid to flow therethrough from the fresh liquid spray tube 315 downwardly through the forward container 314', from the bottom region thereof through the cross-over pipes 341 to the corresponding bottom region of the rearward container 314", and upwardly therethrough to the overflow channel 337 and drain 339, thus providing a continuous liquid flow through the apparatus counterdirectinally to the flow path P of the textile material M. This system of liquid flow causes lint, debris and the like released from the material M during the agitating operation of the apparatus 310 to be carried out of the apparatus into the drain channel 337 and pipe 339 with the overflowing liquid. The liquid in the apparatus 310 is thereby maintained in a substantially constant state of cleanliness with the cleanest liquid in the forwardmost container 314' through which the material M being treated passes last. In this manner, the circulating system best enhances the effectiveness of the washing process and the cleanliness of the material M upon exiting the apparatus 310.

The apparatus 310 of this embodiment of the present invention will thus be understood to provide substantially the same advantages as discussed above with respect to the embodiment of FIGS. 1–9 in providing a vigorous liquid agitation and application to the material being treated for maximized cleaning and treating effect, as well as providing a comparable self-cleaning liquid circulating system, all in a compact economical apparatus. Indeed, the apparatus of this embodiment, being adapted for wet processing of textile materials other than carpet which are of substantially smaller widths and thicknesses, has overall exterior dimensions in the described embodiment of only 100 inches in width, 102 inches in height and 60 inches in depth, providing substantial economy in terms of both liquid and floor space usage.

The present invention has been described in detail above for purposes of illustration only and is not intented to be limited by this description or otherwise to exclude any variation or equivalent arrangement that would be apparent from, or reasonably suggested by the foregoing disclosure to the skill of the art.

I claim:

1. An apparatus for wet processing a continuous traveling web of material comprising a container for containing processing liquid, means for directing a traveling continuous web of material through said container and the processing liquid therein, agitating means disposed in the liquid in said container adjacent the path of travel of said web material therethrough, and means for reciprocably moving said agitating means generally parallel to said material path and relative to said material and liquid, said agitating means having a plurality of individual enlarged liquid displacement cylinders spaced along said agitating means generally paralel to and adjacent said material path with said displacement cylinders being substantially disconnected from one another forming open areas intermediate said displacement cylinders, each said displacement cylinder occupying a sufficiently large extent of said container transversely of said material path so that relatively low velocity movement of said agitating means causes said displacement cylinder of said agitating means to force adjacent liquid to pass at a relatively high velocity between said traveling web material and said displacement cylinder uniformly in each direction of reciprocal movement of said agitating means, resulting in enhanced application of said liquid to said web material, said container including a wall generally parallel to said material path, each said displacement cylinder being of a sufficient radius that the spacing between the center of said displacement cylinder and said wall is at least three times greater than the spacing between said wall and the closet extent of said displacement cylinder, whereby movement of said agitating means produces a substantially more rapid movement of fluid adjacent said material path.

2. An apparatus for wet processing a continuous traveling web of material according to claim 1 and characterized further in that said displacement member extends transversely across the width of said traveling web material and projects at generally equilateral inclinations to the path of travel of the web material for directing liquid toward said web material.

3. An apparatus for wet processing a continuous traveling web of material according to claim 1 and characterized further in that said wall is corrugated to further enhance the agitation of said liquid upon movement of said agitating means.

4. An apparatus for wet processing a continuous traveling web of material according to claim 1 and characterized further in that said agitating means includes a plurality of at least three of said displacement members spaced unequally from each other to avoid repetitive patterned application of said liquid to said material upon reciprocation of said agitating means.

5. An apparatus for wet processing a continuous traveling web of material according to claim 1 and characterized further in that said directing means directs said material in a generally vertical path and said means for reciprocating said agitating means imparts thereto at least a component of vertical movement, and said agitating means is of a weight to have a neutral buoyancy in said liquid to require generally equal forces for moving said agitating means in each reciprocal direction.

6. An apparatus for wet processing a continuous traveling web of material according to claim 5 and characterized further in that said displacement member has a enclosed hollow area containing a sufficient quantity of liquid to produce said neutral buoyancy.

7. An apparatus for wet processing a continuous traveling web of material according to claim 1 and characterized further in that said web material is textile sheet material.

8. An apparatus for wet processing a continuous traveling web of material according to claim 7 and characterized further in that said textile sheet material is tufted, having tufts projecting therefrom in facing relation to said agitating means during travel of said material through said apparatus.

9. An apparatus for wet processing a continuous traveling web of material according to claim 8 and characterized further by means for heating said liquid for producing bulking of said tufts upon reciprocation of said agitating means.

10. An apparatus for wet processing a continuous traveling web of material according to claim 1 and characterized further by means for circulating said liquid through said container and for removing lint therefrom comprising pump means for delivering liquid into said container at the bottom thereof, means for receiving overflow of said liquid from the top of said container for maintaining said liquid at a predetermined level in said container, means for delivering said overflow liquid to said pump means, and filter means in said overflow receiving means for separating lint conveyed with said overflow liquid.

11. An apparatus for wet processing a continuous traveling web of material according to claim 10 and characterized further in that said overflow receiving means includes trough means for containing said overflow liquid, said material directing means including means for directing said material through said trough means after passing through said container, said means for delivering said overflow liquid to said pump including conduit means between said trough means and said pump, and said filter means including screen means in said trough means about said conduit means for separating lint from said overflow liquid entering said conduit means.

12. An apparatus for wet processing a continuous traveling web of material according to claim 11 and means for continuously wiping accumulated lint from said screen means.

13. An apparatus for wet processing a continuous traveling web of material according to claim 12 and characterized further in that said overflow receiving means includes overflow means for removing a portion of said liquid from said liquid circulating means and said liquid circulating means further includes means for adding fresh liquid to said pump means for replacing said removed liquid.

14. An apparatus for wet processing a continuous traveling web of material comprising a container having two spaced parallel walls for containing processing liquid, means for directing a traveling continuous web of material in a generally vertical path through said container and the processing liquid therein in a U-shaped path having two spaced parallel reaches respectively adjacent and parallel to said container walls, agitating means disposed in the liquid in said container in the space between said reaches and adjacent said traveling web material therethrough, and means for reciprocating said agitating means with at least a component of vertical movement generally parallel to said reaches and relative to said material and liquid, said agitating means having a plurality of individal enlarged elongate liquid displacement members and frame means affixing said displacement members in generally parallel spaced relation extending transversely across the width of said traveling web material with said displacement members being substantially disconnected from one another forming open areas intermediate said displacement members, said displacement members projecting from a common central plane of their reciprocal movement outwardly toward each reach of said web to define relatively narrow localized spacings between said displacement members and said container walls, said narrow localized spacings being substantailly narrower than the spacing between said common plane and said walls at said open areas between said displacement members, and each displacement member being configured of a generally equilateral shape relative to each reach of said web and occupying a sufficiently large extent of said container transversely of said reaches of said web in relation to said spacing between said common plane and said walls at said open areas so that relatively low velocity reciprocal movement of said agitating means causes said displacement members to displace adjacent liquid in said open areas so that relatively low velocity reciprocal movement of said agitating means causes said displacement members to displace adjacent liquid in said open areas through said narrow localized spacings at substantailly higher velocity uniformly in each direction of reciprocal movement of said agitating means to force said liquid to be vigorously applied to said web material, said agitating means being of a weight to have a neutral buoyancy in said liquid to require generally equal forces for moving said agitating means in each reciprocal direction.

15. An apparatus for wet processing a continuous traveling web of material according to claim 14 and characterized further in that each said displacement member comprises a cylinder for directing liquid toward said web material, each said cylinder having a sufficient radius that said spacing between said common plane and each said wall is at least three times greater than said localized spacings.

16. An apparatus for wet processing a continuous traveling web of material according to claim 15 and characterized further in that said agitating means includes at least three said displacement members unequally spaced from each other to avoid repetitive patterned application of said liquid to said material upon reciprocation of said agitating means.

17. An apparatus for wet processing a continuous traveling web of material according to claim 16 and characterized further in that said web material is textile sheet material.

18. An apparatus for wet processing a continuous traveling web of material according to claim 17 and characterized further in that said textile sheet material is tufted, having tufts projecting therefrom in facing relation to said agitating means during travel of said material through said reaches.

19. An apparatus for wet processing a continuous traveling web of material according to claim 18 and characterized further by means for heating said liquid for producing bulking of said tufts upon reciprocation of said agitating means.

20. An apparatus for wet processing a continuous traveling web of material according to claim 18 and characterized further by means for circulating said liquid through said container and for removing lint therefrom comprising pump means for delivering liquid into said container at the bottom thereof, means for receiving overflow of said liquid from the top of said container for maintaining said liquid at a predetermined level in said container, means for delivering said overflow liquid to said pump means, and filter means in said overflow receiving means for separating lint conveyed with said overflow liquid.

21. An apparatus for wet processing a continuous traveling web of material according to claim 20 and characterized further in that said overflow receiving means includes trough means for containing said overflow liquid, said material directing means including means for direcitng said material through said trough eans after passing through said container, said means for delivering said overflow liquid to said pump including conduit means between said trough means and said pump, and said filter means including screen means insaid trough means about said conduit means for separating lint from said overflow liquid entering said conduit means.

22. An apparatus for wet processing a continuous traveling web of material according to claim 21 and means for continuously wiping accumulated lint from said screen means.

23. An apparatus for wet processing a continuous traveling web of material according to claim 20 and characterized further in that said overflow receiving means includes overflow means for removing a portion of said liquid from said liquid circulating means and said liquid circulating means further includes means for adding fresh liquid to said pump means for replacing said removed liquid.

24. An apparatus for wet processing a continuous traveling web of material according to claim 17 and characterized further by a second container, second web directing means, second agitating means and second reciprocating means of the type of the first-described ones thereof, said first and second web directing means being associated for directing said web from said first container into said second container, and means for circulating said liquid through said first and second containers including means for delivering liquid to said second container at the top thereof, means for providing liquid communication between said first and second containers for flow of liquid from said second container into said first container, and means at the top of said first container for overflow of liquid from said first container, thereby for producing a flow of liquid through said containers generally counterdirectional to the movement of said material therethrough.

25. An apparatus for wet processing a continuous traveling web of material according to claim 24 and characterized further in that said second container is open at the top thereof and said second web directing means is arranged to withdraw said web from said second container through said open top thereof, said means for delivering liquid to the top of said second container including spray means arranged for directing liquid onto said web upon leaving the top of said second container so that said liquid from said spray means drains from said web into said second container.

26. An apparatus for wet processing a continuous traveling web of material according to claim 24 and characterized further in that said walls of said containers are corrugated to further enhance the agitation of said liquid upon reciprocation of said agitating means.

27. An apparatus for wet processing a continuous traveling web of material according to claim 14 and characterized further in that said displacement member has an enclosed hollow area containing a sufficient quantity of liquid to produce said neutral buoyancy.

28. An apparatus for wet processing a continuous traveling web of material according to claim 14 and characterized further in that said agitating means includes at least three said displacement members unequally spaced from each other to avoid repetitive patterned application of said liquid to said material upon reciprocation of said agitating means.

29. An apparatus for wet processing a continuous traveling web of material according to claim 14 and characterized further by means for circulating said liquid through said container and for removing lint therefrom comprising pump means for delivering liquid into said container at the bottom thereof, means for receiving overflow of said liquid from the top of said container for maintaining said liquid at a predetermined level in said container, means for delivering said overflow liquid to said pump means, and filter means in said overflow receiving means for separating lint conveyed with said overflow liquid.

30. An apparatus for wet processing a continuous traveling web of material according to claim 14 and characterized further by a second container, second web directing means, second agitating means and second reciprocating meas of the type of the first-described ones thereof, said first and second web directing means being associated for directing said web from said first container into said second container, and means for circulating said liquid through said first and second containers including means for delivering liquid to said second container at the top thereof, means for providing liquid communication between said first and second containers for flow of liquid from said second container into said first container, and means at the top of said first container for overflow of liquid from said first container, thereby for producing a flow of liquid through said containers generally counterdirectional to the movement of said material therethrough.

31. An apparatus for wet processing a continuous traveling web of textile material comprising a container for containing processing liquid, means for directing a traveling continuous web of textile material through said container and the processing liquid therein in a generally vertical path, agitating means disposed in said liuqid in said container adjacent the path of travel of said web material therethrough, means for reciprocably moving said agitating means in a generally vertical path generally parallel to said material path and relative to said material and liquid to force adjacent liquid to be applied to said web material, said agitating means having a plurality of enlarged liquid displacement portions in generally parallel unequally spaced relation to one another to avoid repetitive patterned application of said liquid to said material upon reciprocation of said agitating means, said agitating means further being of a weight to have neutral buoyancy in said liquid to require generally equal forces to be exerted by said reciprocably moving means for moving said agitating means in each reciprocal direction, and means for circulating said liquid through said container and for removing lint therefrom comprising pump means for delivering liquid into said container at the bottom thereof, means for receiving overflow of said liquid from the top of said container for maintaining said liquid at a predetermined level in said container, means for delivering said overflow liquid to said pump means, and filter means in said overflow receiving means for separating lint conveyed with said overflow liquid.

32. An apparatus for wet processing a continuous traveling web of textile material comprising a container for containing processing liquid, means for directing a traveling continuous web of textile material through said container and the processing liquid therein in a generally vertical path, agitating means disposed in said liquid in said container adjacent the path of travel of said web material therethrough, means for reciprocably moving said agitating means in a generally vertical path generally parallel to said material path and relative to said material and liquid to force adjacent liquid to be applied to said web material, said agitating means having a plurality of enlarged liquid displacement portions in generally parallel unequally spaced relation to one another to avoid repetitive patterned application of said liquid to said material upon reciprocation of said agitating means, said agitating means further being of a weight to have neutral buoyancy in said liquid to require generally equal forces to be exerted by said reciprocably moving means for moving said agitating means in each reciprocal direction.

33. An apparatus for wet processing a continuous traveling web of material comprising a container for containing processing liquid, means for directing a traveling continuous web of material in a generally vertical path through said container and the processing liquid therein, agitating means disposed in the liquid in said container adjacent the path of travel of said web material therethrough, and means for reciprocally moving said agitating means with at least a component of vertical movement generally parallel to said material path and relative to said material and liquid, said agitating means having a plurality of individual enlarged liquid displacement members spaced along said agitating means generally parallel to and adjacent said material path with said displacement members being substantially disconnected from one another forming open areas intermediate said displacement members, each said displacement member being configured of a generally equilaterally shape relative to said material path and occupying a sufficiently large extent of said container transversely of said material path so that relatively low velocity movement of said agitating means causes said displacement member of said agitating means to force adjacent liquid to pass at a relatively high velocity between said traveling web material and said displacement member uniformly in each direction of reciprocal movement of said agitating means, resulting in enhanced application of said liquid to said web material, said agitating means being of a weight to have a neutral buoyancy in said liquid to require generally equal forces for moving said agitating means in each reciprocal direction.

34. An apparatus for wet processing a continuous traveling web of material according to claim 33 and characterized further in that said displacement member has a hollow area containing a sufficient quantity of liquid to produce said netural buoyancy.

35. An apparatus for wet processing a continuous traveling web of material comprising a container for containing processing liquid, means for directing a traveling continuous web of material through said container and the processing liquid therein, agitating means disposed in the liquid in said container adjacent the path of travel of said web material therethrough, means for reciprocably moving said agitating means generally parallel to said material path and relative to said material and liquid, said agitating means having a plurality of individual enlarged liquid displacement members spaced along said agitating means generally parallel to and adjacent said material path with said displacement members being substantially disconnected from one another forming open areas intermediate said displacement members, each said displacement member being configured of a generally equilateral shape relative to said material path and occupying a sufficiently large extent of said container transversely of said material path so that relatively low velocity movement of said agitating means causes said displacement member of said agitating means to force adjacent liquid to pass at a relatively high velocity between said traveling web material and said displacement member uniformly in each direction of reciprocal movement of said agitating means, resulting in enhanced application of said liquid to said web material, means for circulating said liquid through said container and for removing lint therefrom comprising pump means for delivering liquid into said container at the bottom thereof, trough means for receiving and containing overflow of said liquid from the top of said container for maintaining said liquid at a predetermined level in said container, said material directing means including means for directing said material through said trough means after passing through said container, conduit means between said trough means and said pump means for delivering said overflow liquid to said pump means, and screen means in said trough means about said conduit means for separating lint from said overflow liquid entering said conduit means.

36. An apparatus for wet processing a continuous traveling web of material according to claim 35 and means for continuously wiping accumulated lint from said screen means.

37. An apparatus for wet processing a continuous traveling web of material according to claim 36 and characterized further in that said overflow receiving means includes overflow means for removing a portion of said liquid from said liquid circulating means and said liqud circulating means further includes means for adding fresh liquid to said pump means for replacing said removed liquid.

38. An apparatus for wet processing a continuous traveling web of textile sheet material having tufts projecting therefrom, comprising a container having two spaced parallel walls for containing processing liquid, means for directing a traveling continuous web of material through said container and the processing liquid therein in a U-shaped path having two spaced parallel reaches respectively adjacent and parallel to said container walls, agitating means disposed in the liquid in said container in the space between said reaches and adjacent said traveling web material therethrough, the tufts of said material projecting therefrom in facing relation to said agitating means during travel of said material through said reaches, and means for reciprocating said agitating means generally parallel to said reaches and relative to said material and liquid, said agitating means having a plurality of at least three individual enlarged elongate liquid displacement cylinders and frame means affixing said displacement cylinders in generally parallel spaced relation extending transversely across the width of said traveling web material with said displacement members being substantially disconnected form one another forming open areas intermeadiate said displacement cylinders, said displacement cylinders projecting from a common central plane of their reciprocal movement outwardly toward each reach of said web to define relatively narrow localized spacings between said displacement members and said container walls, said narrow localized spacings being substatantially narrower than the spacing between said common plane and said walls at said open areas between said displacement members, and each said displacement cylinder having a sufficient radius that said spacing between said common plane and each said wall is at least three times greater than said localized spacings for cccupying a sufficiently large extent of said container transversely of said reaches of said web in relation to said spacing between said common plane and said walls at said open areas so that relatively low velocity reciprocal movement of said agitating means causes said displacement members to displace adjacent liquid in said open areas through said narrow localized spacings at substantially higher velocity uniformly in each direction of reciprocal movement of said agitating means to force said liquid to be vigorously applied to said web material, said displacement cylinders being unequally spaced from each other to avoid repetitive patterned application of said liquid to said material upon reciprocation of said agitating means, means for circulating said liquid through said container and for removing lint therefrom comprising pump means for delivering liquid into said container at the bottom thereof, through means for receiving and containing overflow of said liquid from the top of said container for maintaining said liquid at a predetermined level in said container, said material directing means including means for directing said material through said trough means after passing through said container, conduit means between said trough means and said pump means for delivering said overflow liquid to said pump means, and screen means in said trough means about said conduit means for separating lint from said overflow liquid entering said conduit means.

39. An apparatus for wet processing a continuous traveling web of material according to claim 38 and characterized further by means for continuously wiping accumulated lint from said screen means.

40. An apparatus for wet processing a continuous traveling web of material according to claim 38 and characterized further in that said overflow receiving means includes overflow means for removing a portion of said liquid from said liquid circulating means and said liquid circulating means further includes means for adding fresh liquid to said pump means for replacing said removed liquid.

* * * * *

UNITED STATES PATENT AND TRADEMARK OFFICE

CERTIFICATE OF CORRECTION

PATENT NO. : 4,702,092

DATED : October 27, 1987

INVENTOR(S) : James K. Turner

It is certified that error appears in the above-identified patent and that said Letters Patent is hereby corrected as shown below:

Column 1, line 59: Delete "substantailly" and insert -- substantially --.

Column 3, line 28: Delete "line" and insert -- lint --.

Column 7, line 51: Delete "ahs" and insert -- has --.

Column 8, line 10: Delete "communicatin" and insert -- communication --.

Column 9, line 17: Delete "assebly" and insert -- assembly --.

Column 9, line 22: Delete "rough" and insert -- trough --.

Column 11, lines 9-10: Delete "agi-taitng", and insert -- agitating --.

Column 11, line 33: Delete "substantailly" and insert -- substantially --.

Column 11, line 59: Delete "16" and insert -- 116 --.

Column 12, line 40: Delete "conventinal" and insert -- conventional --.

Column 13, line 15: Delete "temperture" and insert -- temperature --.

Column 14, line 28: Delete "enchance" and insert -- enhance --.

Column 14, line 54: Delete "therof" and insert -- thereof --.

Column 15, line 22 : Delete "openngs" and insert -- openings --.

UNITED STATES PATENT AND TRADEMARK OFFICE

CERTIFICATE OF CORRECTION

PATENT NO. : 4,702,092

DATED : October 27, 1987

INVENTOR(S) : James K. Turner

It is certified that error appears in the above-identified patent and that said Letters Patent is hereby corrected as shown below:

Column 16, line 26: Delete "counterdirectinally" and insert -- counterdirectionally --.

Column 16, line 57: Delete "intented" and insert -- intended --.

Column 17, line 5: Delete " paralel" and insert -- parallel --.

Column 18, line 59: Delete "individal" and insert --individual--.

Column 19, line 3: Delete "substantailly" and insert -- substantially --.

Column 19, line 18: Delete "substantailly" and insert -- substantially --.

Column 20, line 4: Delete "direcitng" and insert -- directing --.

Column 21, line 39: Delete "liuqid" and insert -- liquid --.

Column 22, line 52: Delete "netural" and insert -- neutral --.

Column 23, line 35: Delete "liqud" and insert -- liquid --.

Column 23, line 57: Delete "tranv-" and insert -- trans- --.

Column 24, line 1: Delete "sersely" and insert -- versely --.

Column 24, line 4: Delete "intermeadiate" and insert -- intermediate --.

Column 24, line 10: Delete "substatantially" and insert --substantially --.

UNITED STATES PATENT AND TRADEMARK OFFICE

CERTIFICATE OF CORRECTION

PATENT NO. : 4,702,092

DATED : October 27, 1987

INVENTOR(S) : James K. Turner

It is certified that error appears in the above-identified patent and that said Letters Patent is hereby corrected as shown below:

Column 24, line 16: Delete "cccupying" and insert --occupying --.

Signed and Sealed this

Twentieth Day of March, 1990

*Attest:*

*Attesting Officer*

JEFFREY M. SAMUELS

*Acting Commissioner of Patents and Trademarks*